United States Patent [19]

Watkins

[11] 4,450,663

[45] May 29, 1984

[54] INSULATIVE ROOF STRUCTURE

[76] Inventor: Norman C. Watkins, P.O. Box 474, State Rte. EE, Camdenton, Mo. 65020

[21] Appl. No.: 273,666

[22] Filed: Jun. 15, 1981

[51] Int. Cl.[3] ..... E04C 1/24; E04D 1/08

[52] U.S. Cl. ..... 52/309.4; 52/309.8; 52/518

[58] Field of Search ..... 52/309.4, 309.5, 309.6, 52/309.7, 309.8, 408, 409, 410, 518, 515, 309.1, 105; 428/319.1

[56] References Cited

U.S. PATENT DOCUMENTS

| | | | |
|---|---|---|---|
| 388,700 | 8/1888 | Manahan | 52/105 |
| 2,861,525 | 11/1958 | Curtis et al. | 52/515 |
| 3,455,076 | 7/1969 | Clarvoe | 52/309.8 |
| 3,466,222 | 9/1969 | Curtis | 52/309.8 |
| 3,541,745 | 11/1970 | Probst | 52/105 |
| 3,878,658 | 4/1975 | Davis et al. | 52/410 |
| 3,906,693 | 9/1975 | Todorovic . | |
| 4,063,395 | 12/1977 | Stewart . | |
| 4,073,997 | 2/1978 | Richards et al. | 52/309.4 |
| 4,121,958 | 10/1978 | Koonts | 428/311.7 X |
| 4,163,349 | 8/1979 | Smith . | |
| 4,223,487 | 9/1980 | St. Clair . | |
| 4,282,697 | 8/1981 | Spielau et al. | 52/309.4 |
| 4,284,674 | 8/1981 | Sheptak | 52/309.5 |

FOREIGN PATENT DOCUMENTS

| | | | |
|---|---|---|---|
| 1094606 | 12/1967 | United Kingdom | 52/309.4 |

OTHER PUBLICATIONS

"Ply-Foam", brochure of McArthur Co., St. Paul, Minn.

*Primary Examiner*—James L. Ridgill, Jr.
*Attorney, Agent, or Firm*—Litman, Day & McMahon

[57] ABSTRACT

An insulative roof structure for application to a roof deck comprises a rigid foam panel having an upper surface and a longitudinal groove opening onto said upper surface. A rigid elongated strip having an upper surface is positioned within the groove with the strip upper surface being generally flush with the panel upper surface. A kraft board lamina including barrier means is bonded to the panel upper surface. A mechanical fastener extends through the lamina, the strip, the panel and into the deck for retaining the panel against the roof deck. A weather resistant membrane is adhesively bonded to the lamina.

10 Claims, 5 Drawing Figures

Fig. 1.
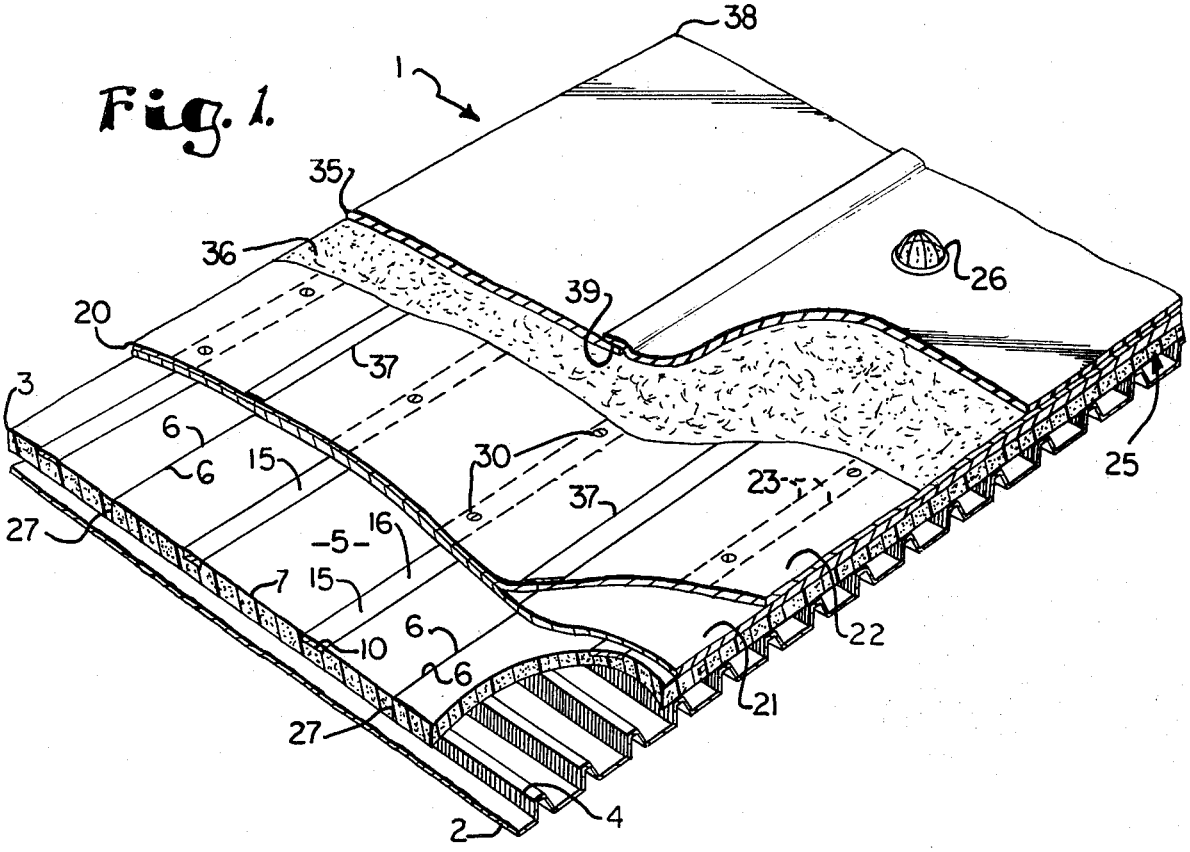
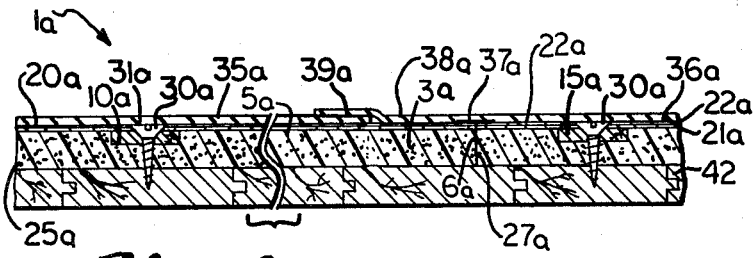
Fig. 3.
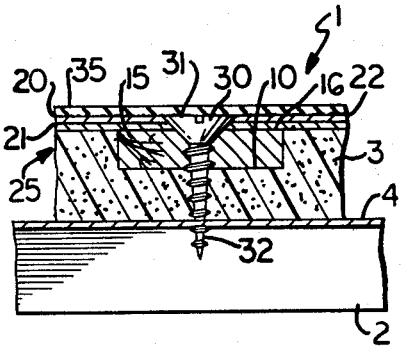
Fig. 2.
Fig. 4.
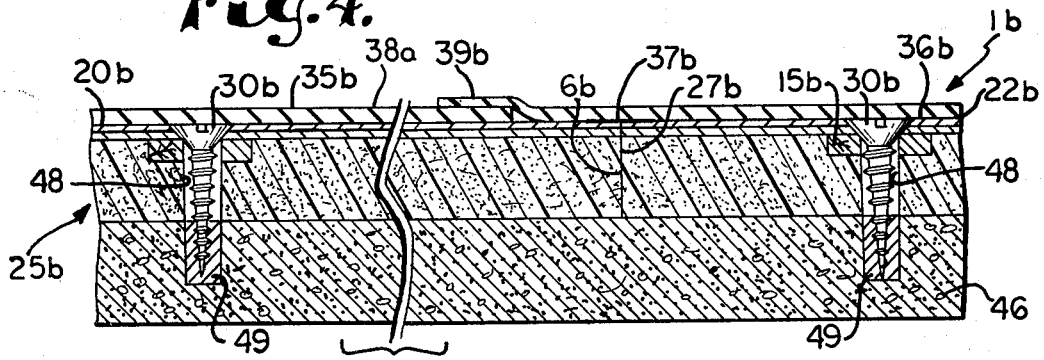

INSULATIVE ROOF STRUCTURE

BACKGROUND OF THE INVENTION

This invention relates to insulative roof structures, and in particular, to a roof structure for application to a generally flat roof deck.

Roof structures for flat-roofed buildings may comprise a variety of different combinations of materials. Such combinations generally include a material selected for its ability to withstand continued exposure to the elements, including precipitation and the decomposing effects of the sun's ultraviolet rays. An insulative material is also generally included for its resistance to heat transfer between the enclosed structure and the outside environment. Such roof structures must generally also be strong enough to withstand the uplifting forces of wind blowing thereover and to support workers walking thereon.

One extensively used prior art roof system comprises a plurality of layers of roofing felt saturated with and adhered together by bituminous material. Such a system is generally designated a "built-up roof" and may include a layer of fiberboard or other insulative material between the roof deck and the felt layers. Because the bituminous material of such a roof system is generally black in color and therefore absorptive of the sun's rays, it is particularly susceptible to deterioration caused thereby and generally must be protected by placement, for example, of light colored gravel or stones thereover. Although built-up roofs may be industry rated for useful life spans of up to as much as twenty years, among their disadvantages is the fact that substantial amounts of field labor are required for positioning of the multiple layers of roofing felt, mopping the bituminous material thereon and evenly spreading the gravel or rock layer thereover.

An alternative structure to the built-up roof is a weather resistant elasto-plastic membrane which may comprise, for example reinforced polyvinyl flouride, butyl rubber, vinylidene chlorides and flourides, polyesters, polyvinyl chloride, neoprene, chlorosulfonated polyethylene, polysulfides, polyurethanes, polyepoxies, acrylates, and other materials having suitable mechanical strength and weather durability. Such structures are generally designated "single-ply roofs" because a single thickness of the weather-resistant membrane is generally sufficient, as compared with the plurality of layers of roofing felt generally required for built-up roofs. In addition to the membrane, a layer of insulating material is also generally provided between the membrane and the roof deck of the structure in single-ply roofs.

The insulative material used in conjunction with such a single-ply roof structure may comprise a synthetic organic polymeric material characterized by low density, light weight, low heat transmission and rigidity. Such materials include closed cell thermosetting foams from, for example, epoxy, isocyanurate sulfoxy linked polyesters, polycarbonate and polystyrene, polyethelene and other polyolefinic materials. In using such foam materials in combination with elasto-polymeric membranes, a barrier lamina should be provided therebetween to prevent plasicizers in the membrane from migrating down into the foam material. Kraft paper, for example, is known to be usable as such a barrier lamina between the foam and the membrane.

Normally in roof structures comprising weather-resistant membranes and insulative foam materials, means must also be provided for securely attaching the roof structure to the underlying roof deck. Such fastening means must be capable of holding down the roof structure against the uplifting forces caused by wind passing thereover. One prior art system for holding down the weather-resistant membrane involves adhesively bonding it to the underlying foam. For example, see the Stewart et al U.S. Pat. No. 4,063,395 showing an upper membrane integral with the upper face of an insulating core. However, to practice this invention, the adhesives used for bonding such weather-resistant membranes must be compatible with the insulating foam material. An alternative prior art method of holding down the weather-resistant membrane involves placing a layer of stone or gravel ballast thereover, the weight of which prevents the membrane from being uplifted by wind blowing thereover. However, such a ballast layer adds another material and another step to the installation process of such a roof structure, thereby increasing the associated costs and construction time. Also, such ballast adds to the dead load which must be supported by the roof deck of the underlying structure.

The foam material comprising the insulative portion of such a roof structure must also be held down to the roof deck by means capable of resisting uplifting wind forces. The prior art includes several mechanical type hold down fastening systems. One such system, for example, utilizes a plurality of washers positioned at spaced intervals with respect to individual sheets of the foam material each having a mechanical fastener extending through a respective washer, the foam sheet and into the roof deck. However, if the roof structure employing such a hold down system is subjected to a particularly strong uplifting force, the foam material often tends to break apart in the area surrounding individual washers and their respective mechanical fasteners whereby certain portions of the foam material become unrestrained. Once the foam surrounding an individual washer breaks, additional stress is put on the other washers which must respectively restrain larger areas of the foam material. Therefore, a single failure at the location of such a washer and mechanical fastener can lead to entire panels being uplifted and blown off a roof. The mechanical fasteners restraining such individual washers are also prone to working loose from the roof deck and piercing the overlying membrane, thereby allowing water to saturate the foam material and enter the structure below.

A different mechanical fastening system for a roof structure using insulating foam panels is shown in the Stewart et al U.S. Pat. No. 4,063,395 which shows panels comprising a substrate board with a foam sheet bonded thereto and a weather resistant membrane adhesively bonded in covering relation thereover. However, the washers with screws therethrough are all positioned in the channels between adjacent foam sheets, thereby leaving the inner portions of such sheets unrestrained by the mechanical fasteners. Thus, substrate boards having sufficient strength and rigidity to hold down the portions of the roof structure between the mechanical fasteners must be adhesively bonded to the underside of the foam sheets in the practice of the roof system shown in that patent.

The present invention provides an insulative roof structure for an application to a roof deck comprising rigid foam as an insulative material and a weather resistant elasto-plastic membrane. A kraft paper lamina with barrier means is adhesively bonded to the foam panel and provides a barrier between it and the foam. The membrane is adhesively bonded to the lamina. The foam panels are mechanically fastened to the roof deck by a plurality of fasteners extending through the lamina, a rigid elongated strip set into the rigid foam panel, the rigid foam panel and into the roof deck. The mechanical fasteners extending through the rigid elongated strip cooperate therewith to exert a retaining force over considerable portions of the foam panel. Also, the metal foil layer of the lamina provides a base for adhesively bonding the membrane to the kraft paper lamina.

OBJECTS OF THE INVENTION

Therefore, the objects of the present invention are: to provide a roof structure with a high resistance to heat transfer; to provide such a roof structure with an effective, weather resistant membrane, to provide such a roof structure utilizing rigid foam as an insulative material; to provide such a roof structure which provides a barrier between the weather-resistant membrane and the foam material; to provide such a roof structure which includes a lamina comprising kraft paper with an upper layer of metal foil and positioned between the weather resistant membrane and the foam material; to provide such a roof structure which is mechanically fastened to a roof deck; to provide such a roof structure utilizing rigid elongated strips recessed into the foam material for receiving mechanical fasteners therethrough; to provide such a roof structure which is light in weight, to provide such a roof structure which effectively resists wind uplift; and to provide such a roof structure which may be quickly and inexpensively constructed; to provide such a roof structure which is economical to manufacture efficient in use, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a fragmentary perspective view of a roof structure embodying the present invention, shown applied to a metal roof deck.

FIG. 2 is an enlarged and fragmentary vertical cross-sectional view of the roof structure, particularly showing the placement of screws for holding down the roof structure to the roof deck.

FIG. 3 is a fragmentary vertical cross-sectional view of a first modified embodiment of a roof structure according to the present invention shown attached to a wood roof deck.

FIG. 4 is a fragmentary vertical cross-sectional view of a second modified embodiment of a roof structure according to the present invention, shown attached to a concrete roof deck.

DESCRIPTION OF THE PREFERRED EMBODIMENTS

Figure 5:
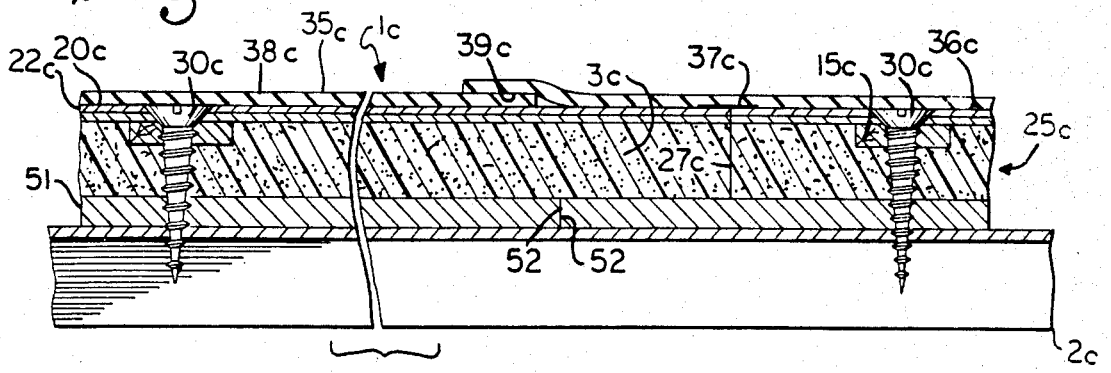
FIG. 5 is a fragmentary vertical cross-sectional view of a third modified embodiment of a roof structure according to the present invention including a layer of fire-resistant material over a metal roof deck.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

For purposes of description herein, the terms "upper", "lower", "vertical", "horizontal", and derivatives thereof shall relate to the invention as oriented in FIGS. 2–4, however, it is to be understood that the invention may assume various alternative orientations, except where expressly specified to the contrary.

The reference numeral 1 generally designates an insulative roof structure applied to a corrugated metal roof deck 2, including a plurality of ridges 4 extending parallel with respect to each other. The roof structure 1 includes a plurality of rigid foam panels 3 applied to the metal roof deck 2. In the practice of the present invention, the rigid insulative panels 3 are preferably formed from a variety of synthetic organic polymeric foams generally characterized by low density, light weight, and low thermal conductance. Without limitation on the generality of useful materials, the rigid foam panels may comprise closed cell thermosetting foams of polyurethane, epoxy, isocyanurate, sulfoxy linked polyesters, polycarbonates, polystyrene, polyvinyl chloride, polyvinyl acetate, phenol formaldehyde, urea formaldehyde, silicone, acrylics, synthetic rubber, polyethelene or other polyolefinic material. Preferably, the rigid foam panels 3 comprise such a foam material having closed cells with a corresponding low permeability to moisture. However, foam having open cells may also be used for producing the rigid foam panels 3. A rigid foam that is particularly compatible with the present invention is comprised of expanded polystyrene, a closed cell, resilient, light weight foamed plastic. Expanded polystyrene is manufactured from expandable polystryrene containing a blowing agent and a flame retardant additive. When heated, the blowing agent expands to produce the moisture resistant closed cells. The cells are then thermally fused into blocks (not shown) which are cut into the panels 3 of the present invention.

Expanded polystyrene is particularly useful for insulation in the roof structure 1 of the present invention because of its low thermal conductivity, light weight, moisture resistance and relatively low cost to produce. Expanded polystyrene has a K factor (thermal conductivity expressed in B.t.u./(hr.) (sq. ft.) (deg. F./in)) in the range of approximately 0.20–0.26. This equates to an R value (thermal resistance) in the range of approximately 3.85–5.0 per inch of thickness. For most roof applications, expanded polystyrene with a density in the range of 1.0–2.0 pounds per cubic foot (p.c.f.) is used, although densities of up to 3.0 p.c.f. are available for specialized applications requiring additional strength. Even when saturated to a moisture content of 10 times its dry weight, the expanded polystyrene retains its dimensional stability and approximately 80% of its dry R value. However, the material is resistant to moisture permeation and, preferably, in the practice of the present invention, the foam panels 3 are shielded from contact with moisture.

The relatively light weight of the expanded polystyrene panels 3 facilitates ease of installation because they can be easily lifted in large quantities to the roof decks 2. Also, the rigid foam panels 3 contribute little additional dead load to the roof deck 2 which may thereby be supported by lighter and less expensive structural members than conventional roof structures imposing greater dead loads per square foot.

Each rigid foam panel 3 has an upper surface 5, a pair of opposite side edges 6 and a pair of opposite end edges 7. The panels 3 are placed on the metal roof deck 2 with their opposite side edges 6 and opposite end edges 7 in abutting relation with corresponding edges 6 and 7 of adjacent foam panels 3. The rigid foam panels 3 as shown are rectangular with dimensions of approximately eight feet along their opposite side edges 6 and approximately four feet along their opposite end edges 7. However, rigid foam panels having other suitable polygonal shapes may be utilized in the practice of the present invention.

Each rigid foam panel 3 includes a pair of grooves 10 extending longitudinally with respect thereto between its respective opposite end edges 7 in spaced relation from and parallel to respective opposite side edges 6. The grooves 10, as shown, are rectangular in cross-sectional configuration and open onto the upper surfaces 5 of respective panels 3. Each groove 10 has positioned therein a rigid elongated wood strip 15 having a corresponding rectangular cross-sectional configuration. Each wood strip 15 has an upper surface 16 which is substantially flush with an associated foam panel upper surface 5. Although longitudinally extending grooves 10 are shown, grooves extending transversely between the side edges 6 or diagonally with respect to the panels 3 could also be employed in the practice of the present invention. Further, elongated strips comprising other rigid material such as metal could be utilized in place of the wood strips 15.

A lamina 20 preferably comprising a lower layer of kraft board 21 and barrier means is bonded to the upper surface 16 of each rigid foam panel 3. The kraft board 21 comprises wood pulp prepared with a sodium sulfate solution which is bondable to the rigid foam panels 3 utilizing a suitable adhesive. The barrier means in the illustrated embodiment consists of an upper layer of metal foil 22 in overlying relation to the kraft board 21. The lamina 20 is normally applied to the upper surface 5 of a respective foam panel 3 under pressure after application of the adhesive to facilitate permeation of the foam material with the adhesive and thereby strengthen the resulting bond. A pair of lines 23 preprinted on the metal foil 22 comprises an indicia designating the location of each wood strip 15 after placement of the lamina 20 thereover.

In the practice of the present invention, it is contemplated that premade reinforced panels 25 comprising the rigid foam panels 3 with the rigid wood strips 15 positioned in their grooves 10 and the lamina 20 bonded thereto may be fabricated elsewhere and shipped to the building site for attachment to the roof deck 2. Because of the relatively light weight of the polystyrene material, the reinforced panels 25 are easily handled by workers. Also, their light weight facilitates hoisting the reinforced panels 25 to elevated roof surfaces.

The reinforced panels 25 of the insulative roof structure 1 are easily cut with a knife or saw to required dimensions for completely covering the roof deck 2 and to provide openings for protrusions above the insulative roof structure 1, such as a roof drain 26.

When the reinforced panels 25 are placed on the roof deck 2, both are secured together by suitable mechanical fasteners such as screws 30 each having a head 31 and a shank 32. The screws 30 may be of the self-tapping type with shanks 32 which are driven through the lamina 20, the wood strip 15, the foam panel 3 and partially into the ridges 4 of the roof deck 2, after which they may be tightened with a screw driver until their heads 31 engage the lamina 20. Alternatively, holes for the screws 30 may be drilled through the reinforced panels 25 and into the roof deck 2 for receiving the screws 30. Also, other mechanical type fasteners may be utilized in the practice of the present invention, such as nails.

The screws 30 which attach each reinforced panel 25 to the roof deck 2 are longitudinally spaced along each respective rigid wood strip 15. The screws 30 are placed between the pairs of lines 23 which comprise indicia for locating the wood strips 15 at a predetermined spacing so that they will engage respective ridges 4 of the metal roof deck 2 when driven. The rigid foam panels 3 when applied to the roof deck 2 are thus reinforced with the wood strips 15 which also receive the screws 30 for attachment of the rigid foam panel 3 to the roof deck 2. The wood strips 15 provide a washer-type effect whereby the screws 30 cooperate with respective strips 15 to hold down a respective reinforced panel 25. Thus, if one of the screws 30 should work itself loose or fail to attach to the roof deck 2 when installed, the rigid wood strip 15 would provide a continuous reinforcement between the adjacent screws 30 on either side of the unattached screw 30. The loss of the retaining force exerted by one screw 30 would therefore have little effect on the structural integrity of the entire reinforced panel 25.

The cooperative effect of the screws 30 and the wood strips 15 of the present invention is particularly effective for retaining the reinforced panels 25 when the roof structure 1 is subjected to the uplifting forces of the wind blowing thereover. The insulative roof structure 1 of the present invention, when constructed as described herein, is designed to pass a Factory Mutual Class I-90 simulated wind uplift pressure test when applied in accordance with Factory Mutual Loss Prevention Data 1-28. Therefore, the calculated strength of the insulative roof structure 1 far exceeds the requirements for most commercial roof structures, which are required to meet only a Factory Mutual Class I-60 simulated wind uplift pressure test.

A weather-resistant membrane 35 is applied to the metal foil 22 of the lamina 20 by a suitable adhesive 36. The membrane 35 preferably comprises an elasto/-polymeric material as utilized in "single-ply" roof structures as opposed to "built-up" roof structures comprising mulitiple layers of roofing felt saturated with bitumen. Without limitation on the generality of useful materials, the membrane 35 may be formed of ethylene propylene diene monomer (EPDM), modified bitumen (MB), reinforced modified bitumen (MB/R), polychloroprene or neoprene (NEO), polyvinyl chloride (PVC), chlorinated polyethylene (CPE), polyisobutylene (PIB), or ethylene-copolymer-bitumen and anthracite microdust (ECB). The adhesive 36 is chosen for its compatibility with the material comprising the membrane 35.

Many of the aforementioned elasto/polymeric membrane materials contain plasticizers which would tend to migrate into the rigid foam panels 3 if the membrane 35 were applied directly thereto. Therefore, the metal foil 22 of the lamina 20 is utilized to function both as the barrier means for preventing the migration of such plasticizers between the membrane 35 and the rigid foam panels 3 and as a base for receiving the adhesive 36 for bonding the membrane 35.

The membrane 35 is normally applied in the field to the panels 25 which have been attached to and substantially cover the roof deck 2. Polyethylene tape 37 is applied to the joints 27 between abutting panels 25 to provide a barrier between the adhesive 36 and the rigid foam panels 3 if the adhesive 36 is of a type which is harmful to the foam panels 3. However, some of the adhesives 36 recommended for use with the membrane 35 do not attack some of the foam materials which may comprise the foam panels 3, and in such an application, the joint tape 37 may be omitted. After the joint tape 37 is applied, the adhesive 36 is rolled or brushed onto the metal foil 22 of the reinforced panels 25. The weather resistant membrane 35 is then normally rolled out as a series of continuous parallel strips 38 over the reinforced panels 25 coated with the adhesive 36. Adjacent membrane strips 38 overlap each other to form lap joints 39 whereat respective strips 38 are bonded together with the adhesive 36.

In an alternative type of single-ply roof structure within the scope of the present invention, a weather-resistant membrane is placed over a lamina with a metal foil upper layer, but not adhesively bonded thereto. Gravel or stone ballast (not shown) is then placed on the weather-resistant membrane to hold it down against the lamina. The metal foil layer prevents the adhesive which joins the adjacent membrane strips from contacting the foam and causing damage thereto.

The resulting roof structure 1 of the present invention provides a tough weather-resistant covering for the roof deck 2 with a considerable savings in both material and installation costs as compared with conventional built-up and other roof systems which generally comprise more layers of materials than the roof structure 1 of the present invention. The foam material comprising the panels 4 provides a thermal barrier and is relatively light weight and inexpensive. The wood strips 15 provide reinforcement for the foam panels 3 and also provide an efficient means for anchoring the reinforced panels 25 to the roof deck 2 with mechanical fasteners. The lamina 20 functions as a barrier between the membrane 35 and the rigid foam panels 3 and its surface of metal foil 22 functions as a base for adhering the membrane 35 to the reinforced panels 25 with the adhesive 36. Therefore, the cooperative effect of the reinforced panels 25 with the lamina 20 and the weather-resistant membrane 35 produces the roof structure 1 which is strong, relatively inexpensive and has a favorable thermal conductivity value.

The reference numeral **1*a* (FIG. 3) generally represents a first modified embodiment of a roof structure according to the present invention applied to a wood roof deck 42. Since the roof structure 1*a* is similar to the previously described roof structure 1, similar parts appearing in FIG. 3 and FIGS. 1 and 2 respectively are represented by the same, corresponding reference numeral except for the addition of the suffix "a" to the numerals of the modified structure. The roof structure 1*a* comprises rigid foam panels 3*a* each including an upper surface 5*a* and longitudinal grooves 10*a*. Rigid wood strips 15*a* are adhesively bonded in respective grooves 10*a* and function to reinforce the foam panels 3*a***.

Lamina **20*a* each comprising a kraft board lower layer 21*a* and a metal foil upper layer 22*a* are adhesively bonded to respective rigid foam panels 3*a*, resulting in reinforced panels 25*a*. The reinforced panels 25*a* are placed on the wood roof deck 42 with their respective opposite side edges 6*a* in abutting relationship to define butt joints 27*a* therebetween. The wood strips 15*a* also function to receive screws 30*a* for holding down the reinforced panels 25*a* against the wood roof deck 42. As with the previously described insulative roof structure 1, other mechanical fasteners such as nails may be utilized in place of the screws 30*a***.

The butt joints **27*a* may be covered with joint tape 37*a* to provide a barrier between the rigid foam panels 3*a* and an adhesive 36*a* which is applied to the foil facing 22*a*. Strips 38*a* of a weather resistant membrane 35*a* are then rolled out over the reinforced panels 25*a* which has been previously coated with the adhesive 36*a*. The adjacent membrane strips 38*a* overlap to define lap joints 39*a* which are connected with the adhesive 36*a***.

The reference numeral **1*b* (FIG. 4) generally represents a second modified embodiment of a roof structure according to the present invention applied to a concrete roof deck 46. Since the insulative roof structure 1*b* is otherwise similar to the previously described roof structure 1, similar parts appearing in FIG. 4 and FIGS. 1 and 2 respectively are represented by the same corresponding reference numerals except for the addition of the suffix "b" to the numerals of the modified device. A plurality of reinforced panels 25*b* are positioned with respective opposite side edges 6*b* in abutting relationship on the concrete roof deck 46. To attach the reinforced panels 25*b*, a plurality of holes forming receivers 48 are drilled in alignment through overlaying lamina 20*b*, respective wood strips 15*b*, rigid foam panels 3*b*, and into the concrete roof deck 46. A plurality of the receivers 48 are drilled through each reinforced panel 25*b* at predetermined positions whereby the receivers extend through respective wood strips 15*b* and into the concrete roof deck 46 therebelow. Screws 30*b* with suitable friction-type anchors 49 partially threaded onto their ends are then inserted into the receivers 48 whereby the anchors 49 are imbedded in the concrete roof deck 46. The screws 30*b* are then tightened, causing the anchors 49 to expand outwardly against the receivers 48 and thereby provide a friction grip for retaining the screws 30*b* in the concrete roof deck 46. Although the screws 30*b* with the anchors 49 are shown, other mechanical fasteners such as concrete nails driven by either a hammer or an explosive charge may be utilized for attaching the reinforced panels 25*b* to the concrete roof deck 46**.

As with the previously described embodiments, butt joints **27*b* between the panel opposite side edges 6*b* are covered with joint tape 37*b*. A metal foil upper layer 22*b* is coated with the adhesive 36*b* and the strips 38*b* of the weather resistant membrane 35*b* are rolled out thereon. The adjacent strips 38*b* overlap to define the lap joint 39*b***.

The reference numeral **1*c* (FIG. 5) generally represents a third modified embodiment of a roof structure according to the present invention having an underlayment of $\frac{5}{8}$ inch thick fire-rated gypsum board 51. Since the insulative roof structure 1*c* is similar to the previously described roof structure 1, similar parts appearing in FIG. 5 and FIGS. 1 and 2 respectively are represented by the same, corresponding reference numeral except for the addition of the suffix "c" to the numerals of the modified roof structure. The roof structure 1c includes the layer of gypsum board 51 positioned between a metal roof deck 2c and the rigid foam panels 3c whereby the insulative roof structure 1c qualifies for a Factory Mutual Class I fire rating. Although the gypsum board 51** is shown, other fire-resistant underlayment materials such as ¾ inch thick perlite board may also be used.

The gypsum board panels 51 are placed on the metal roof deck 2c with their respective edges 52 in abutting relationship. Reinforced panels 25c are then placed thereover and secured by screws 30c extending through overlaying lamina 20c, wood strips 15c, the rigid foam panels 3c, the gypsum board panels 51 and into the metal roof deck 2c. Butt joints 27c between the adjacent reinforced panels 25c are covered with joint tape 37c and adhesive at 36c is applied on top of a metal foil upper layer 22c. Strips 38c of a weather-resistant membrane 35c are then rolled out over the reinforced panels 25c coated with the adhesive at 36c. The adjacent membrane strips 38c define lap joints 39c therebetween which are bonded with the adhesive.

The gypsum board panels 51 provide a heat insulative material between the metal roof deck 2c and the rigid foam panels 3c. Such a heat barrier may be required for the insulative roof structure 1c to qualify for a Factory Mutual Class I rating because many of the materials of which the rigid foam panels 3c are comprised are combustible. In the event of a fire within a building covered by the roof structure 1c, the gypsum board panels 51 would provide a thermal barrier between the metal roof deck 2c and the rigid foam panels 3c, thereby preventing or at least delaying their combustion. Also, the gypsum board panels 51 increase the thermal resistance or R value of the insulative roof structure 1c.

It is to be understood that while certain embodiments of the present invention have been illustrated and described herein, it is not to be limited to the specific forms or arrangement of parts described and shown.

What is claimed and desired to secure by Letters Patent is:

1. An insulative roof structure for application to a roof deck comprising:

(a) a single-layer synthetic organic polymer closed cell foam panel including an upper surface, a pair of opposite edges and a longitudinal groove opening onto said panel upper surface; said groove extending generally parallel to and in spaced relation from said edges;

(b) an elongated strip of rigid reinforcing material positioned in said groove and having a strip upper surface generally flush with said panel upper surface;

(c) a lamina comprising a lower layer of kraft board and an upper layer of metal foil bonded directly to said kraft board, said kraft board layer being bonded to said panel upper surface;

(d) a plurality of mechanical fasteners for retaining said panel against a roof deck, each of said fasteners including:

(1) a head portion engaging said lamina metal foil upper layer; and (2) a shank portion extending through said lamina, said strip and said panel; said fastener shank portion being embedded in said roof deck whereby said insulative roof structure is retained on top of said roof deck; and (e) a single-ply elasto-polymeric weather-resistant membrane including a plasticizer, said membrane overlying and being bonded to said metal foil layer by an adhesive; said metal foil layer providing a barrier between said foam panel and said plasticizer in said membrane and said metal foil layer providing a base for said adhesive whereby said membrane is bonded to said lamina; said membrane being exposed and substantially uncovered.

2. The roof structure as set forth in claim 1 which includes:

(a) said strip being comprised of wood and having a rectangular cross-sectional configuration; and (b) said groove having a rectangular cross-sectional configuration corresponding to said cross-sectional configuration of said strip; and wherein (c) said mechanical fastener shank portion being threadedly engaged in said roof deck.

3. The roof structure as set forth in claim 2 which includes:

(a) anchor means positioned in said roof deck for receiving said fastener shank portion.

4. The roof structure as set forth in claim 1 wherein said panel is rectangular and includes:

(a) a pair of opposite end edges;

(b) a pair of opposite side edges;

(c) said groove extending between said pair of end edges and generally parallel to and spaced from said pairs of side edges.

5. The roof structure as set forth in claim 1 wherein:

(a) said closed cell synthetic organic polymer comprises expanded polystyrene; and (b) said paper pulp material comprises kraft board treated with a sodium sulfate solution.

6. The roof structure as set forth in claim 1 which includes:

(a) indicia printed on said lamina and designating the position of an associated elongated strip therebeneath when said foil layer is in overlaying relationship with respect to said associated strip.

7. The roof structure as set forth in claim 1 which includes:

(a) a layer of fire-resistant material positioned between said roof deck and said panel.

8. An insulative roof structure for application to a roof deck comprising:

(a) a single-layer synthetic organic polymer closed cell foam panel including:

(1) an upper surface;

(2) a pair of opposite ends;

(3) a pair of opposite side edges; and (4) a plurality of spaced longitudinal grooves each extending between said pair of end edges and generally parallel to and spaced from said pair of opposite side edges, said grooves opening onto said panel upper surface;

(b) a plurality of elongated wood strips each positioned in a respective groove and having an upper surface generally flush with said panel upper surface;

(c) a lamina comprising a lower layer of kraft board treated with a sodium sulfate solution and an upper layer of metal foil bonded directly to said kraft board; said kraft board layer being bonded to said panel upper surface;

(d) a plurality of mechanical fasteners for retaining said panel against a roof deck, each of said mechanical fasteners including:

(1) a head portion engaging said lamina metal foil upper layer; and (2) a shank portion extending through in overlying sequence said lamina, a respective elongated strip, said panel and into said roof deck, said shank portion being embedded in said roof deck; and (e) a single-ply elasto-polymeric weather-resistant membrane overlying and being adhesively bonded to said metal foil layer.

9. The roof structure as set forth in claim 8 which includes:

(a) anchor means positioned in said roof deck for receiving said fastener shank.

10. The roof structure as set forth in claim 8 which includes:

(a) a layer of fire resistant material positioned between said roof deck and said panel.

* * * * *